United States Patent [19]

Smith

[11] Patent Number: 4,877,195

[45] Date of Patent: Oct. 31, 1989

[54] ROLLED WEB HOLDER

[76] Inventor: Charles A. Smith, 3404 Winchester Rd., Louisville, Ky. 40207

[21] Appl. No.: 258,874

[22] Filed: Oct. 17, 1988

[51] Int. Cl.[4] ..... B65D 85/67; B65H 19/00

[52] U.S. Cl. ..... 242/55.2; 206/390; 206/416

[58] Field of Search ..... 242/55.2, 68.3; 206/389, 390, 416

[56] References Cited

U.S. PATENT DOCUMENTS

| | | | |
|---|---|---|---|
| D. 155,897 | 11/1949 | Huntington | 242/552 X |
| 858,613 | 7/1907 | Mather | 242/55.2 |
| 3,061,217 | 10/1962 | Grant | 242/55.2 |
| 3,806,057 | 4/1974 | Whatley | 242/55.2 X |
| 4,344,583 | 8/1982 | Drum | 242/55.2 |

*Primary Examiner*—William Price

*Attorney, Agent, or Firm*—Edward M. Steutermann

[57] ABSTRACT

A holder for a web material wound onto a hollow generally cylindrical core including a base member for attachment to supporting base means with a generally "T" shaped bracket extending laterally therefrom where the bracket is planar and includes a leg base attached to the base member and a laterally extending arm member of selected width, a first generally planar support having an aperture therein generally conforming to the cross sectional periphery of the arm member to be received thereon and rest on the leg base where the width of the arm is generally equal to the diameter of the core of the web of material, and a second cover member having a geometric configuration generally congruent to the geometric configuration of the outer periphery of the web of material having an opening therein having a geometric configuration generally similar to the geometric configuration of the periphery of the cross section of the arm member.

1 Claim, 1 Drawing Sheet

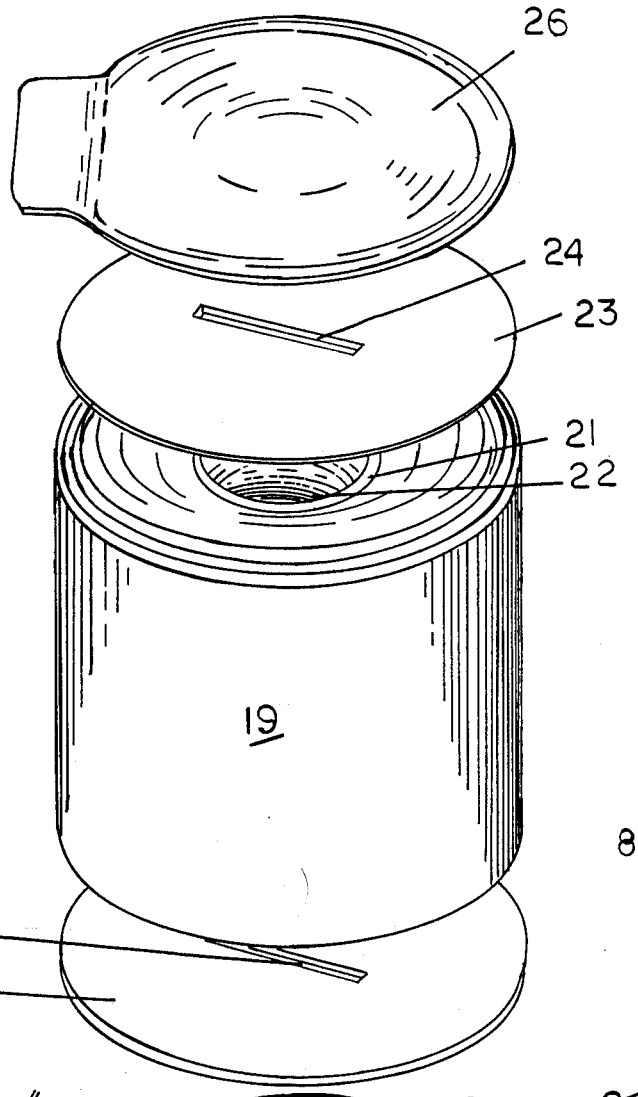
Fig 1
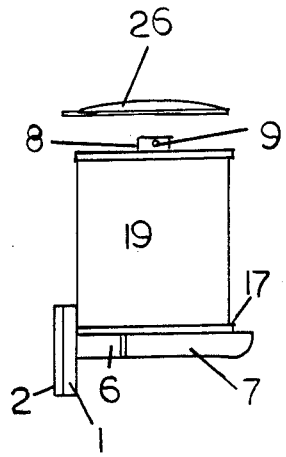
Fig 2
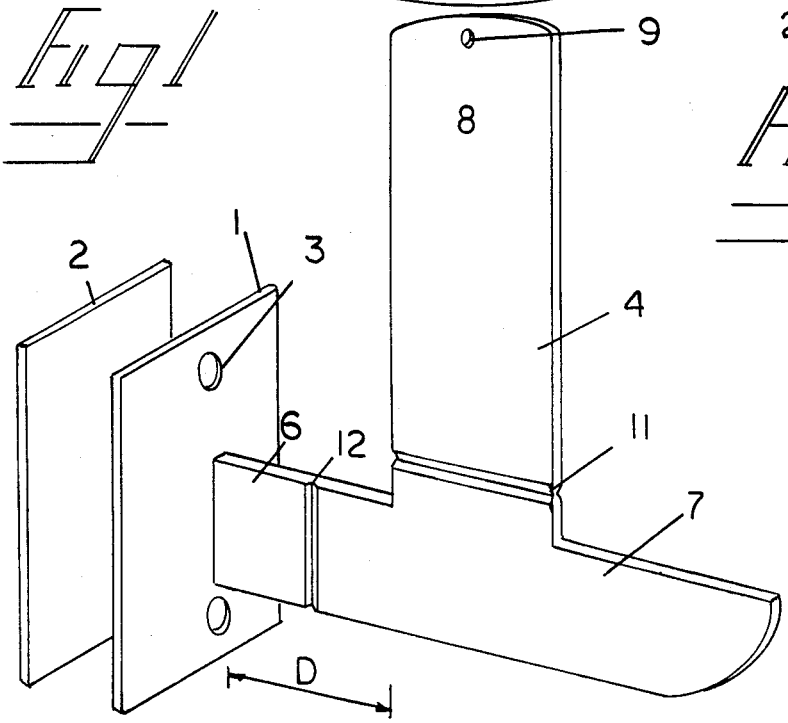

ROLLED WEB HOLDER

BACKGROUND OF THE INVENTION

The present invention relates in general to a device to hold a web of material wound onto hollow core and is directed particularly to a device to hold, store, and facilitate dispensing a web of bathroom tissue. The prior art illustrates various means for holding or storing webs of material and in some instances dispensing such material from a roll or stack but no prior art device is known which provides the features of the present invention to facilitate storing a roll of bathroom tissue in an attractive and unobtrusive manner, for example, in a bathroom.

Likewise, it is generally recognized that the cost of toilet tissue is significantly less than the cost of tissues normally utilized in connection with various activities and in this connection, for example, is used by artists, women in applying and or removing cosmetics makeup and other similar activities.

It is further recognized that the present invention provides a convenient means of storing a roll of toilet tissue in a convenient manner for later usage or for use as discussed above where the individual sheets or length of the material can be removed from the roll without permitting the roll to unwind.

Known prior art includes U.S. Pat. No. 3,704,776 which illustrates one means of storing a roll of bathroom tissue in an attractive enclosure. U.S. Pat. No. 2,994,488 illustrates an example of a dispenser which can be utilized to dispense a web of material from a roll but does not include the features in accordance with the present invention.

U.S. Pat. No. 3,490,578 likewise teaches a dispensing device but does not teach a dispensing device which is mounted to a base.

U.S. Pat. No. Des. 267,864 teaches a toilet paper holder and dispenser which as with U.S. Pat. No. 3,490,578 does not teach a means for holding the device nor does it have the structural attributes of devices within the scope of the present invention.

U.S. Pat. No. 1,588,577 like U.S. Pat. No. Des. 267,684 teaches a dispensing device having structural features different from those provided by the present invention. Likewise U.S. Pat. Nos. 4,382,510, 2,095,419 and 2,936,937 teach dispensing devices of a type to dispense a web of material wound onto a core.

However, upon reading the disclosure set forth hereinafter it will be recognized that none of the foregoing references teach devices having features provided by the present invention.

SUMMARY OF THE INVENTION

The present invention provides a new, novel, decorative and useful holder device for a roll of material wound on a hollow core where the device provides means to store the material for ready access in an attractive yet unobtrusive manner.

In addition to utilizing devices within the scope of the present invention for storage of rolled web material, such as bathroom tissue, devices within the scope of the present invention can likewise be utilized for dispensing such materials. Specifically, devices within the scope of the present invention provide an upright planar leg of selected width where the width of the leg can be selected to engage the sides of the core to retard rotation of the web of material upon removal of individual sheets or a length of material to control material dispensing.

Further, devices within the present invention can be fabricated in a manner and design to permit ready inclusion with prepackaged multiple rolled units of tissue so the devices within the scope of the present invention can be furnished as a premium in connection with the sale of tissue also devices within the scope of the present invention can be adapted for mounting to hard surfaces or other bases without tools.

Additionally, various other features such as hinge arrangements can be provided for the structures provided by the present invention to prevent accidental dislodgement of the device from its mounting base and to allow movement of the device in response to the device being struck without breaking the device or knocking the stored web of material from the device.

Additionally, various features can be included to enhance the attractiveness of the device such as a fanciful coverings on the upper surface of the device as described hereinafter in connection with one feature of the present invention or the surfaces can be used for promotional purposes.

Briefly, the present invention provides a holder for a web material wound onto a hollow generally cylindrical core including a base member for attachment to supporting base means with a generally "T" shaped bracket extending laterally therefrom where the bracket is planar and includes a leg base attached to the base member and a laterally extending arm member of selected width, a first generally planar support having an aperture therein generally conforming to the cross sectional periphery of the arm member to be received thereon and rest on the leg base where the width of the arm is generally equal to the diameter of the core of the web of material, and a second cover member having a geometric configuration generally congruent to the geometric configuration of the outer periphery of the web of material having an opening therein having a geometric configuration generally similar to the geometric configuration of the periphery of the cross section of the arm member.

Examples within the scope of the present invention are discussed hereinafter with reference to the Figures associated herewith it will be understood that neither the discussion nor the features hereinafter presented are by way of limitation but or way of example only and that various other arrangements also within the scope of the present invention will occur to those skilled in the art upon reading the disclosure set forth hereinafter.

BRIEF DESCRIPTION OF THE DRAWINGS

Examples within the scope of the present invention are illustrated in the accompanying drawing wherein:

FIG. 1 is a perspective exploded view of a device within the scope of the present invention;

FIG. 2 is an elevational view of an assembled device within the scope of the present invention also illustrating a covering device for a top surface of the unit.

DETAILED DESCRIPTION OF THE DRAWINGS

FIG. 1 presents a perspective illustration of one example of an arrangement within the scope of the present invention which includes a base member 1 which can be attached to a selected surface, for example a vertical surface (not shown) by any convenient means. In FIG. 1 a double sided adhesive 2 is shown which can be adapted to stick one side to the mounting base and the other to the base 1 of the device. Alternatively, holes 3 can be provided so that bolts, screws, or other fastening means can be utilized to secure the assembly to the supporting surface.

A generally "T" shaped bracket means 4 is provided having a first leg 6 attached to the base member 1, for example as unitary molded device, or secured thereto by appropriate fastener means such as adhesives or mechanical fastening devices.

A second portion of the cross bar extends outwardly from an upwardly extending leg means 8. It will be seen that the "T" member 4 is planar in cross section. The width of the leg member 8 can be selected to accommodate various size cores upon which the rolls of material to be stored are wound.

Also an aperture 9 can be provided in the top of the leg member 8 so that a locking mechanism can be inserted there through if desired to prevent unauthorized removal of material from the retainer.

Additionally, a pair of grooves 11 are provided on the leg member 8 closely adjacent the cross bar section 6 and 7 as shown. When the device is manufactured of a resilient plastic or other resilient materials it has been found that the hinge 11 serves a useful purpose in that it permits the assembly to be struck and yet not break away from the stationary surface and not damage the device.

As shown a second of pair of groove members 12 are provided to provide a second hinge segment which allows movement of the device in a second plane without breakage of the device or away from the stationary mounting surface. In the case of the hinge 11 it appears to be preferably that the hinge be located as close as possible to cross member 6 and 7 while with respect to the hinge members 12 the hinge members appear to be satisfactory so long as located somewhere between the base ember 1 and the arm 8 as shown by the dimension D.

Likewise, there is an off set distance "E" between the inside of the arm 8 and the base member 1 which is selected to accommodate the width of the roll of material which it is anticipated will be stored on the device.

The foregoing dimension are of course relevant to the particular application for which the device is intended and may be modified accordingly within the scope of the present invention.

A planar base 17 is provided having an aperture 18 having a perimetrical configuration similar cross sectional configuration of the perimeter of the arm 8 so the arm 8 is received in the aperture 18 with the base 17 resting on the cross members 6 and 7. As in the case of the diameter of the base 17 is selected so the device can be accommodated on the arm 18 and can be moved all the way to engagement with the cross member 6. The roll of material, for example a roll of tissue 19 is provided and is wound on core 21 which defines an aperture 22 which receives the arm 8.

In the case of bathroom tissue it has been found that there is substantial standardization of the size of the cores however, it will be understood that within reasonable limits cores of different diameters can be accommodated on devices in accordance with the present invention simply by squeezing the core and flattening it out a little if the core is to small and inserting it on the arm 8. On the other hand where the diameter on the opening 22 is greater than the width of the arm 8 it has been found that the use of the base 7 in conjunction with the use of a base 23 and 17 described hereinafter satisfactorily locates the roll and maintains it in an upright position on the arm 8.

Turning to the upper cover 23, the periphery of the cover 23 is preferably adapted to accommodate the outer diameter of the roll 19. An aperture 24 is provided in the cover 23 which, like the aperture 18 and base 17, has a perimetrical configuration adapted to accommodate the arm 8.

Where desired, and within the scope of the present invention, an attractive covering, for example a large sea shell 26 can be provided to be glued to the upper cover 23 alternatively the decorative motif can be simply placed thereon for easy removal when it is not desired to use the cover or can be formed as part of the cover 23.

FIG. 2 is plan view of a device within the scope of the present invention in assembled configuration where the base 1 is shown attached to the adhesive strip 2 so the arm 6 and 7 extend horizontally outwardly and the arm member 8 extends upwardly.

The hole 9 is shown to receive a locking mechanism and is shown to be located above the top of the cover 23. The cover 17 is shown in place with the roll 19 thereon. The cover 26 is shown in position to be received on the cover 23 in order to provide an additional element of attractiveness.

It will be understood that the foregoing is but one example of an arrangement within the scope of the present invention and that various other arrangements also within the scope of the present invention will occur to those skilled in the art upon reading the disclosure set forth hereinbefore.

The invention claimed is:

1. A holder for a web material wound onto a hollow generally cylindrical core including a base member for attachment to supporting base means with a generally "T" shaped bracket extending laterally therefrom where the bracket is planar and includes a leg base attached to the base member and a laterally extending arm member of selected width, a first generally planar support having an aperture therein generally conforming to the cross sectional periphery of the arm member to be received thereon and rest on the leg base where the width of the arm is generally equal to the diameter of the core of the web of material, and a second cover member having a geometric configuration generally congruent to the geometric configuration of the outer periphery of the web of material having an opening therein having a geometric configuration generally similar to the geometric configuration of the periphery of the cross section of the arm member.

* * * * *